United States Patent [19]

Parfitt

[11] Patent Number: 4,992,800

[45] Date of Patent: Feb. 12, 1991

[54] WINDSHIELD MOUNTED ANTENNA ASSEMBLY

[75] Inventor: Dale R. Parfitt, Lantana, Fla.

[73] Assignee: Martino Research & Development Co., West Palm Beach, Fla.

[21] Appl. No.: 300,130

[22] Filed: Jan. 23, 1989

[51] Int. Cl.[5] ..... H01Q 1/32

[52] U.S. Cl. ..... 343/713; 343/715; 343/860

[58] Field of Search ..... 343/713, 715, 745, 860

[56] References Cited

U.S. PATENT DOCUMENTS

| | | | |
|---|---|---|---|
| 2,163,471 | 6/1939 | Sharp | 343/713 |
| 2,197,601 | 4/1940 | Wolaver | 343/713 |
| 3,958,245 | 5/1976 | Cherenko et al. | 343/713 |
| 3,964,068 | 6/1976 | Torii et al. | 343/704 |
| 3,971,029 | 7/1976 | Torii et al. | 343/704 |
| 4,089,817 | 5/1978 | Kirkendall | 343/713 |
| 4,238,799 | 12/1980 | Parfitt | 343/715 |
| 4,331,961 | 5/1982 | Davis | 343/704 |
| 4,474,353 | 10/1984 | Martino et al. | 248/534 |
| 4,658,259 | 4/1987 | Blaese | 343/715 |
| 4,746,925 | 5/1988 | Toriyama | 343/713 |
| 4,785,305 | 11/1988 | Shyu | 343/713 |
| 4,794,319 | 12/1988 | Shimazaki | 343/715 |
| 4,825,217 | 4/1989 | Choi | 343/715 |

FOREIGN PATENT DOCUMENTS

| | | | |
|---|---|---|---|
| 0137391 | 4/1985 | European Pat. Off. | 343/715 |
| 3410950 | 9/1985 | Fed. Rep. of Germany | 343/715 |

*Primary Examiner*—Michael C. Wimer

*Attorney, Agent, or Firm*—Hill, Van Santen, Steadman & Simpson

[57] ABSTRACT

A window-mounted antenna assembly has a capacitive connection through the window glass, one plate of the capacitive connection being formed as an area of a printed circuit board which is connected to a coaxial feed by soldering or the like. A shunt inductive circuit is printed on the printed circuit board and matches the coaxial feed to active elements of relatively long electrical length.

4 Claims, 1 Drawing Sheet

FIG. 1
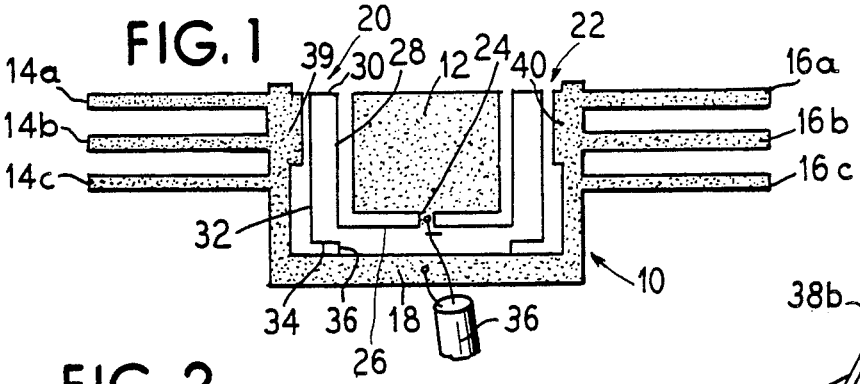
FIG. 2
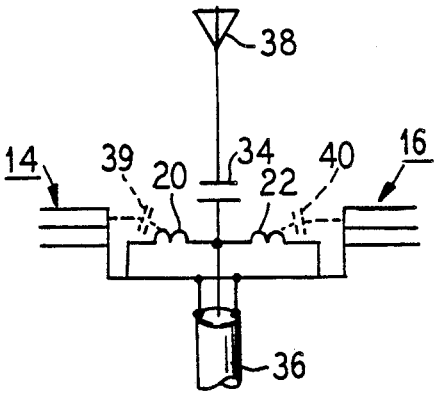
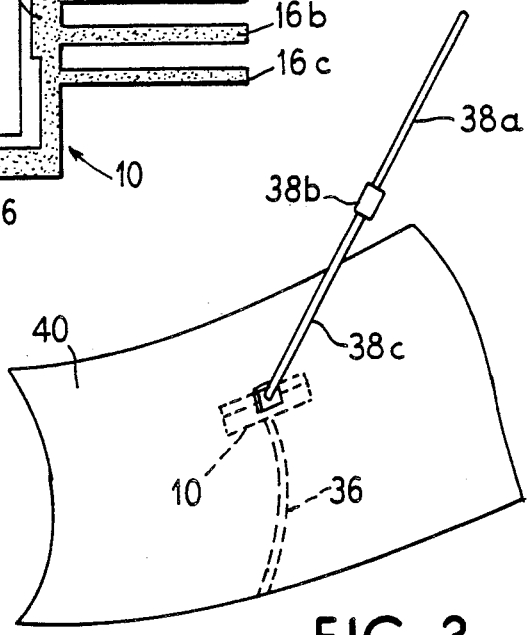
FIG. 3
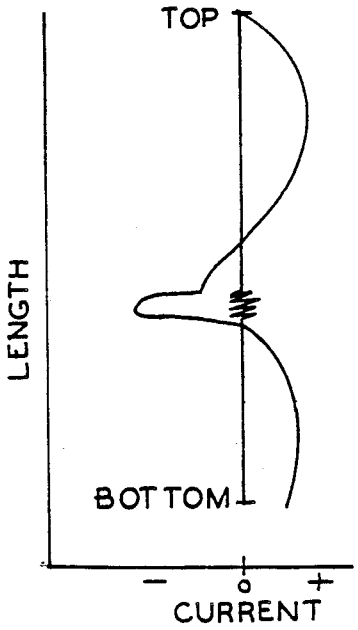
FIG. 4
FIG. 5
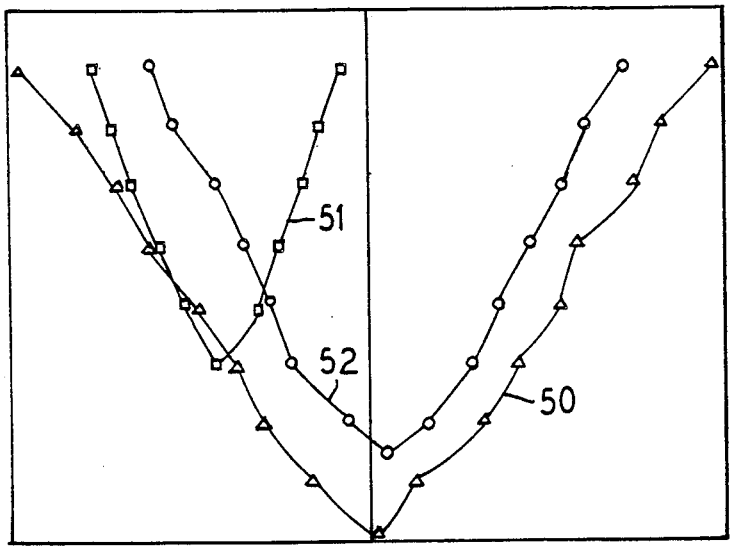

WINDSHIELD MOUNTED ANTENNA ASSEMBLY

BACKGROUND OF THE INVENTION

The present invention relates to windshield mounted antenna assemblies, and more particularly to an antenna having a relatively long effective electrical length.

Window mounted antennas have become popular in connection with local communications, particularly cellular telephone communications. One arrangement is described and claimed in my prior U.S. Pat. No. 4,238,799 for "Windshield Mounted Half-Wave Communications Antenna Assembly". While that assembly has proven to be quite effective, it has been found that, unexpectedly, a simpler and less costly circuit is capable of achieving the same superior response of the previous arrangement, while at the same time effecting considerable savings in complexity and size.

Previous attempts to design a communications antenna with reduced complexity are represented, for example, by U.S. Pat. No. 4,658,259. That arrangement uses a quarter-wavelength antenna, which demands an extensive ground plane to achieve good gain at the horizon and an omnidirectional radiation pattern. However, apparently because of its limited ground plane, this antenna had an average gain some 6 dB below the cellular version of U.S. Pat. No. 4,238,799 and an azimuthal plane pattern characterized by deep nulls.

It is accordingly desirable to provide a window mounted antenna assembly design of reduced complexity, which does not suffer the disadvantages associated with a quarter-wavelength antenna with a small assymetrical and tilted ground plane.

SUMMARY OF THE INVENTION

It is a principal object of the invention to provide a window mounted antenna assembly, with the capability of coupling through the window glass, which has equivalent or superior response characteristics, but without the complexity associated with previously developed half-wave units.

It is another object of the present invention to provide a window mounted antenna assembly, with the capability of coupling through the window glass, which has superior response characteristics, in comparison to a quarter-wavelength antenna with a (loaded) ground plane of limited area.

The above objects are accomplished in the present invention by providing an antenna with colinear active elements, having a relatively long effective electrical length, and with means for capacitively coupling the active elements to a coaxial feed by means of matching techniques etched onto a PC board. An antenna designed in accordance with the present invention has response characteristics equivalent to the previously cited cellular version of U.S. Pat. No. 4,238,799 half-wavelength antenna, without the complexity involved in the previous arrangement.

BRIEF DESCRIPTION OF THE DRAWINGS

Reference will now be made to the accompanying drawings, in which:

FIG. 1 is a plan view of a printed circuit board used in connection with the present invention;

FIG. 2 is a schematic diagram of the equivalent circuit of the present invention;

FIG. 3 is a illustration of the antenna assembly in place on an automobile window;

FIG. 4 is a graph showing current in the antenna (x) relative to length (y); and FIG. 5 is a graph showing the V.S.W.R. characteristics of several antennas.

DESCRIPTION OF THE PREFERRED EMBODIMENT

Referring to FIG. 1, a plan view is illustrated of a circuit board 10, used in the present invention. The circuit board has a central rectangular conductive planar area or panel 12, which forms one plate of a capacitive coupling, using the dielectric of the window glass of an automobile window, with a corresponding capacitor plate mounted on the outside of the window glass. The panel 12 is connected to the central conductor of a coaxial cable at a location 24 by soldering or the like. as described hereinafter, and the outer (grounded) conductor of the coaxial cable is connected to a trace 18 provided on the printed circuit board below the panel 12. The trace is part of a resonant decoupling assembly having six rectangular elongate traces 14*a*, 14*b*, 14*c* and 16*a*, 16*b*, 16*c*.

The traces 14*a*, 14*b*, 14*c* and 16*a*, 16*b*, 16*c* are interconnected by the U-shaped conductive trace or strip 18, on the PC board, and the central panel 12 is connected to the trace 18 by a pair of inductive loops 20 and 22 formed by relatively thin conductive lines printed on the PC board. Rectangular panels 39 and 40, provided at the upper ends of the strip 18, adjacent the traces 14*a*, 14*b* and 16*a*, 16*b*, provide a small amount of edge coupling between a portion of strip 18 and sections of the inductive loops 20, 22.

The panel 12 is connected to a conductive line 24, which extends from the panel toward the conductive trace 18, and terminates at a lateral conductor 26, which extends parallel with the conductor 18, beyond both the left and right sides of panel 12. At the left distal end of the conductor 26, the inductive loop 20 is formed, in electrical contact with the conductor 24, with a length 28 extending away from the conductor 18, an intermediate length 30 extending parallel to the conductor 18, and a length 32 extending in parallel to the length 28 to a point near the conductor 18. From this point, a length 34 extends parallel to the conductor 18 and then a short length 36 joins the end of the length 34 to the conductor 18. The inductor 22 is formed as a mirror image of the inductor 20, on the opposite side of the panel 12. The coaxial feed has its center conductor connected to the line 24, and the outer shield of the coaxial feed is connected to the midpoint of the strip 18. Both connections are made by soldering or the like.

The two inductive loops 20 and 22, formed between the inner and outer coaxial connectors, function to match the impedance of a conventional coaxial cable to the antenna active elements which are capacitively coupled on the other side of the window. The lower active element has a relatively long electrical length, and is nonresonant. Because of the nonresonant nature of this antenna element, the end impedance is reactive, and represents a mismatch with the characteristic impedance of the coaxial cable, which is real. However, the inductive elements 20 and 22 compensate for the reactive characteristic impedance of the nonresonant lower antenna element, and match the antenna element, through the capacitive connection represented by the plate 12. Edge coupling provided by panels 39, 40 further extends the impedance match at the upper end of the cellular phone band. The resulting V.S.W.R. curve is very broad, as shown in FIG. 5 which plots the antenna of the present invention against two other glass mount antennas which are currently commercially available. The response of the present invention is curve 50, and the curves for the two conventional antennas are 51 and 52.

Decoupling the antenna from the coaxial feed line has been a problem with on-glass mounted antennas. When the decoupling is insufficient, radiation currents are conducted along the outer conductor (shield) of the transmission line, which unpredictably alters the gain, V.S.W.R, and radiation pattern of the antenna. In effect, the coaxial line has become part of the antenna, so that degradation in performance results.

The traces 14*a*, 14*b* and 14*c*, as well as the corresponding traces 16*a*, 16*b* and 16*c* on the opposite side, comprise from one point of view, three sets of quarter wave resonant inductive decoupling stubs, which achieve effective transmission line decoupling over the entire cellular telephone band. The upper traces 14*a* and 16*a* have a longer total effective length, e.g., from the end of the trace to the midpoint of the strip 18, for example, and are effective at the low end of the band, while the traces 14*b* and 16*b* decouple at the center portion of the band and the traces 14*c* and 16*c* decouple at the high end of the band. These operations blend together, without any sharp transistion, to result in a superior decoupling, when compared with conventional decoupling techniques.

The antenna is well matched to the conventional 50 ohm coaxial cable by means of the inductive loops 20 and 22, despite the fact that the radiating element terminates at a length which is between integral multiples of a half and quarter wavelength, viz., approximately $\frac{3}{8}$ wavelength. The inductive loops 20 and 22 do not radiate appreciably, which might lower the gain of the antenna assembly.

The placement of the inductive loops 20 and 22 directly on the printed circuit board achieves broad band matching, with no increase in the cost of manufacture or in mechanical complexity.

The pads 39 and 40, which act as edge couplers, and substantially widen the V.S.W.R. curve at the high end of the cellular telephone band. Since the printed circuit board may be fabricated with extreme precision, using conventional printed circuit techniques, the characteristics of the antenna are not subject to variations normally associated with lumped electrical components and mechanical tolerances.

In sum, the antenna of the present invention achieves improvements in gain, bandwidth, feedline decoupling, and results in an assembly which is capable of being made inexpensively with precision. Also, no adjustments are needed, at the time of installation, to compensate for electrical and mechanical variations.

FIG. 2 illustrates the equivalent electrical circuit of the antenna arrangement of the present invention. A capacitor 24 connects the central conductor of the coaxial cable 36 with the active antenna elements 38, which have a reactive impedance.

FIG. 3 shows a view of the antenna assembly in use. The active elements 28 are colinear, comprising an upper element 38*a*, a lower element 38*c* and an intermediate phasing coil 38*b*. Preferably, the electrical length of the upper element is about $\frac{5}{8}$ wavelength, and the lower one is about $\frac{3}{8}$ wavelength.

FIG. 4 illustrates the distribution of current along the length of the active antenna element, with the top of the antenna being a point of zero current. The bottom of the antenna element 83*c* is less than a half wavelength (electrically) from the bottom of phasing coil 38*b* to the base, and represents neither a point of zero maximum current, nor of minimum or maximum voltage in phase elements 13*a*, *c*. However, despite the reactive nature of the antenna element, the antenna is matched in impedance to the characteristic impedance of the coaxial cable 36, resulting in a relatively low standing wave ratio. A low standing wave ratio is indicative of good impedance matching with high efficiency of the antenna, resulting in efficient radiation of transmitted energy, and efficient reception of received energy.

The good impedance match described above is achieved without the need for bulk and expensive transformers, inductors or capacitors, and instead uses a simple PC board which may be relatively made by conventional photoresist techniques, using readily available materials.

Referring to FIG. 3, the antenna elements 38 are illustrated as mounted adhesively to the outside of the window 40, with the PC board 10 being mounted on the inside of the window. The panel 12 faces a plate of the capacitor 34 which is adhesively secured to the outside of the window, and the outside plate is in electoral contact with the active elements 38. Alternatively, the PC board may be mounted on an assembly which itself is adhesively secured to the interior of the window 40, with the result that the PC board is spaced inwardly by a short distance from the glass of the window.

It has been found that with the arrangement described above, that there is a substantial flexibility in positioning the inner and outer elements relative to each other, without degrading the performance of the antenna. This is a surprising result, since in previous windshield mounted antennas, the positioning of the inner and outer capacitor plates has been critical, and a slight mispositioning of the inner and outer plates relatively to each other, has substantially decreased the performance of the antenna. However, in the antenna of the present design, a lateral (meaning left-right) misregistration of the plates of the capacitor 34 makes little difference in the operation of the antenna. It is believed that this may be due to a change in the mutual inductance between the inductors 20 and 22, in such a way as to offset the effect of the mispositioning.

It is apparent, that the antenna assembly of the present invention achieves good performance with a minimum of complexity and bulkiness, and in fact achieves equivalent performance when compared to the previously designed half-wave antenna, without the need of tuning the matching network and with considerably reduced complexity. The PC board 10 establishes all of the critical components in perfect position relative to each other, so that an extreme precision in manufacture is possible, which does not depend on correct assembly of separate components by a technician in the course of installation. In fact, installation of an antenna in accordance with the present invention is noncritical, and sufficient tolerance is exhibited over small amounts of misregistrations which may occur during the course of improper assembly as to make them noncritical.

Their small size leaves the window relatively clear for good visability.

It will be apparent that various modifications and/or additions may be made in the apparatus of the invention without departing from the essential feature of novelty involved, which are intended to be defined and secured by the appended claims.

What is claimed:

1. A window-mounted antenna assembly comprising a printed circuit board, said printed circuit board having a central panel adapted to be connected to the central conductor of a coaxial cable, a U-shaped conductive area surrounding said central panel on at least two opposite sides thereof and joined together on a third side thereof, and inductive means comprising a pair of printed circuit inductors interconnected between said central panel and a central portion of said U-shaped conductive area, for matching the impedance of said coaxial cable to an active antenna element, said antenna element having an electrical length greater than a quarter wavelength capacitively connected to said central panel.

2. Apparatus according to claim 1, where said inductors comprise a printed circuit including a first line extending from said central panel toward the central portion of said U-shaped conductive area, a second thin line connected to said first line and extending in parallel with the central portion of said U-shaped conductive area, a pair of third lines connected to opposite ends of said second line and extending away from the central portion of said U-shaped conductive area, a pair of fourth lines, connected to the distal end of each of said third lines, and extending away from said central panel, and a pair of fifth lines, each connected from the distal end of said fourth lines and extending in parallel to said third lines and connected with the central portion of said U-shaped conductive area.

3. A window mounted antenna assembly comprising an active antenna element having a length of approximately $\frac{3}{8}$ wavelength, panel means for capacitively coupling said antenna element through the glass of an automobile window, said panel means adapted to be connected to the central conductor of a coaxial cable, inductive means connected in shunt between the inner and outer conductors of said coaxial cable, a U-shaped conductor surrounding said panel means and connected to said outer conductor of said coaxial cable, and a printed circuit board, said panel means being formed on said printed circuit board, and said inductive means comprising a pair of inductors formed as thin lines printed on said circuit board and adapted to be interconnected between the central and outer conductors of said coaxial cable.

4. A window mounted antenna assembly comprising an active antenna element having a length of approximately $\frac{3}{8}$ wavelength, panel means for capacitively coupling said antenna element through the glass of an automobile window, said panel means adapted to be connected to the central conductor of a coaxial cable, inductive means connected in shunt between the inner and outer conductors of said coaxial cable, including a plurality of stubs, each of different effective length connected to said outer conductor, said stubs being arranged in two sets on opposite sides of said panel means, with the stubs of each set extending parallel to each other, and including a pair of conductive pads spaced from said inductive means and electrically connected with said stubs, for improving edge coupling between said inductive means and said stubs.

* * * * *